US012480374B2

(12) United States Patent
Milne et al.

(10) Patent No.: US 12,480,374 B2
(45) Date of Patent: Nov. 25, 2025

(54) EXPANDABLE TUBULAR STRUCTURE FOR MAINTAINING DIFFERENTIAL PRESSURE INTEGRITY IN A WELLBORE

(71) Applicant: Halliburton Energy Services, Inc., Houston, TX (US)

(72) Inventors: Adam J. Milne, Carrollton, TX (US); Daniel Keith Moeller, Carrollton, TX (US); Donald Ray Smith, Duncan, OK (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 18/443,426

(22) Filed: Feb. 16, 2024

(65) Prior Publication Data

US 2025/0263992 A1 Aug. 21, 2025

(51) Int. Cl.
*E21B 33/128* (2006.01)
*E21B 23/04* (2006.01)

(52) U.S. Cl.
CPC ..... *E21B 23/0413* (2020.05); *E21B 33/128* (2013.01)

(58) Field of Classification Search
CPC ..... E21B 23/0413; E21B 33/128
See application file for complete search history.

(56) References Cited

U.S. PATENT DOCUMENTS 6,662,876 B2 12/2003 Lauritzen
9,388,662 B2 * 7/2016 Frazier ..... E21B 33/1293
9,976,381 B2 * 5/2018 Martin ..... E21B 23/0413
10,408,012 B2 9/2019 Martin et al.
10,794,132 B2 10/2020 Mhaskar et al.
10,920,523 B2 * 2/2021 Kellner ..... E21B 33/12
11,118,434 B2 * 9/2021 Hazelip ..... E21B 23/01
11,352,540 B2 * 6/2022 Hecht ..... E21B 33/1204
11,391,116 B2 * 7/2022 Jacob ..... E21B 33/129
11,732,546 B1 8/2023 Qiu et al.
11,761,297 B2 * 9/2023 Jacob ..... E21B 33/134 166/387
11,808,105 B2 * 11/2023 Tonti ..... E21B 34/142
12,209,481 B1 1/2025 Patsy et al.
2002/0092654 A1 7/2002 Coronado et al.
2005/0252662 A1 11/2005 Metcalfe et al.
2014/0174763 A1 6/2014 Zhong et al.
2016/0047193 A1 2/2016 Snider et al.
(Continued)

FOREIGN PATENT DOCUMENTS

CA 2840140 A1 * 12/2012 ..... E21B 33/12

OTHER PUBLICATIONS

"PCT Application No. PCT/US2024/016320 International Search Report and Written Opinion", Nov. 5, 2024, 14 pages.
(Continued)

*Primary Examiner* — Aaron L Lembo
(74) *Attorney, Agent, or Firm* — DeLizio, Peacock, Lewin & Guerra LLP

(57) ABSTRACT

An apparatus comprising a singular tubular structure to be positioned inside casing of a wellbore formed in a subsurface formation, wherein the singular tubular structure is configured to expand to contact an inner wall of the casing and provide differential pressure integrity in the wellbore while an isolating component is positioned in the singular tubular structure.

20 Claims, 7 Drawing Sheets

(56) References Cited

U.S. PATENT DOCUMENTS

| | | | | |
|---|---|---|---|---|
| 2016/0186511 | A1 | 6/2016 | Coronado et al. | |
| 2017/0241231 | A1 | 8/2017 | Benzie et al. | |
| 2019/0032445 | A1 | 1/2019 | Dempsey | |
| 2020/0048981 | A1 | 2/2020 | Coon et al. | |
| 2023/0056451 | A1* | 2/2023 | Jacob | E21B 33/1285 |
| 2023/0167705 | A1* | 6/2023 | Jacob | E21B 23/01 166/118 |
| 2023/0175345 | A1* | 6/2023 | Jacob | E21B 33/134 166/386 |
| 2023/0184056 | A1* | 6/2023 | Jacob | E21B 33/128 166/387 |
| 2023/0392469 | A1* | 12/2023 | Molzahn | E21B 33/129 |

OTHER PUBLICATIONS

"PCT Application No. PCT/US2024/016321 International Search Report and Written Opinion", Nov. 13, 2024, 11 pages.
"U.S. Appl. No. 18/443,440 Non-Final Office Action", Feb. 27, 2025, 8 pages.
"U.S. Appl. No. 18/443,440 Final Office Action", Aug. 6, 2025, 7 pages.

* cited by examiner

EXPANDABLE TUBULAR STRUCTURE FOR MAINTAINING DIFFERENTIAL PRESSURE INTEGRITY IN A WELLBORE

TECHNICAL FIELD

This disclosure relation generally to the field of hydraulically fracturing a wellbore in a subsurface formation and more particular to the field frac plugs.

BACKGROUND

In hydrocarbon recovery operations, fluid and sand may be pumped into a wellbore to hydraulically fracture a subsurface formation. The pump rate and pressure from the fluid may fracture the subsurface formation, creating a conduit for the fluid in the subsurface formation to flow to the wellbore and ultimately to the surface. Sand may be pumped with the fluid and placed into the fractures to support said fractures. A wellbore may be hydraulically fractured in one or more stages, where each stage includes clusters of perforations in which the fluid and sand may enter the subsurface formation to fracture said subsurface formation. A frac plug may be positioned between stages to prevent hydraulic communication between stages.

BRIEF DESCRIPTION OF THE DRAWINGS

Implementations of the disclosure may be better understood by referencing the accompanying drawings.

DESCRIPTION

Figure 1:
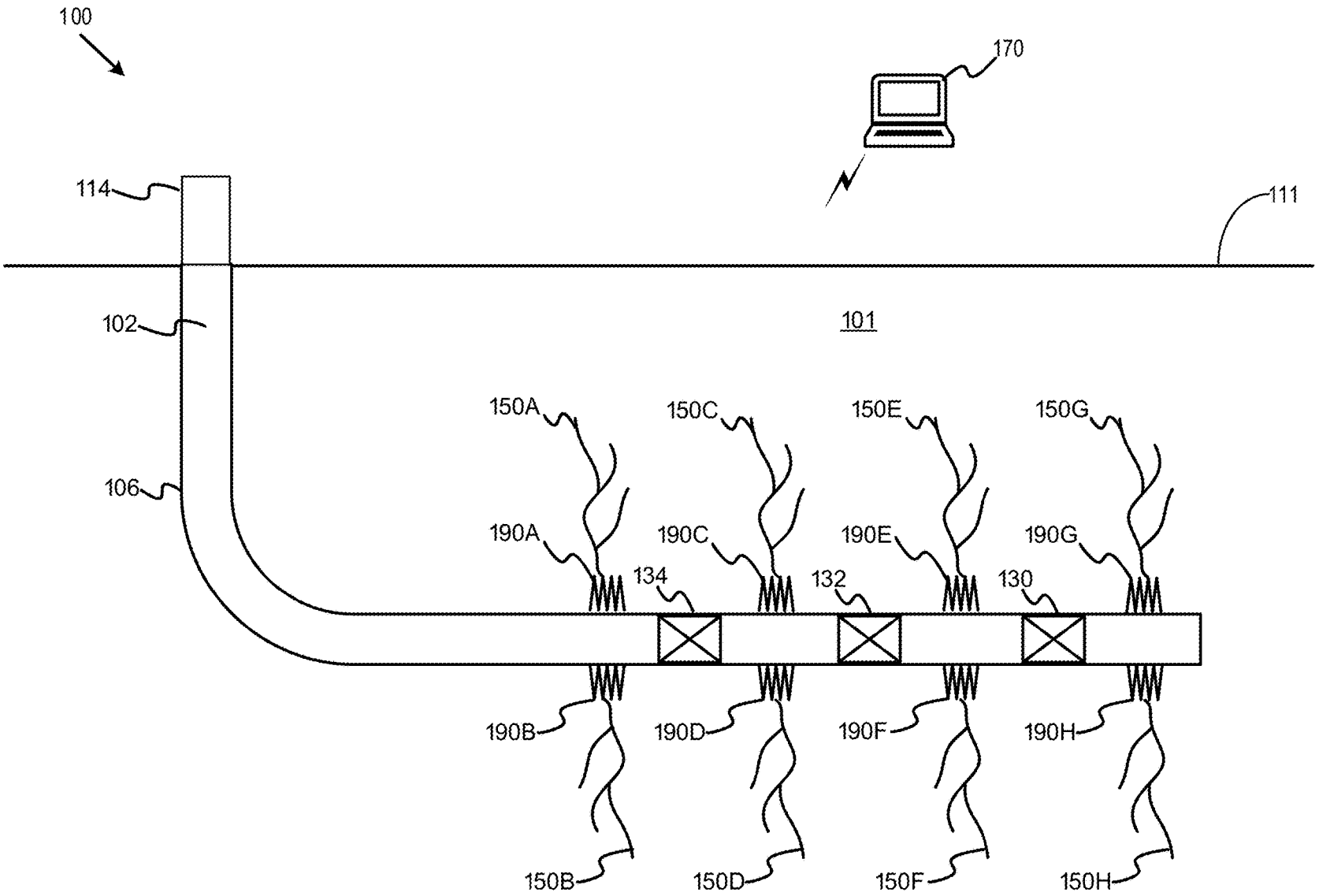
FIG. 1 is an illustration depicting an example well system, according to some implementations.

The description that follows includes example systems, methods, techniques, and program flows that embody aspects of the disclosure. However, it is understood that this disclosure may be practiced without these specific details. For instance, this disclosure refers to an expandable frac plug utilized during hydraulic fracturing operations. Aspects of this disclosure can also be applied to any other scenarios where an expandable plug may be utilized in a wellbore. For clarity, some well-known instruction instances, protocols, structures, and operations have been omitted.

Example implementations relate to a frac plug comprising a singular tubular structure. Frac plugs may be utilized in hydraulic fracturing operations to hydraulically isolate frac stages. A frac plug may be positioned in the casing of a wellbore during hydraulic fracturing operations. A setting assembly may set the frac plug at the desired depth such that the frac plug is held in place in the casing. An isolating component, such as a sealing device (e.g., a cone shaped device, egg shaped device, ball, dart, etc.), may then be positioned in the frac plug to hydraulically isolated the portion of the wellbore below the frac plug (i.e., at depths greater than the frac plug) from the portion of the wellbore above the frac plug (i.e., depths less than the frac plug towards the wellhead). In conventional operations, a frac plug may be configured with multiple components. For example, traditional frac plugs may be configured with a mandrel, one or more slip tools coupled with the mandrel, ratchet features, collet features, etc. When the frac plug is set, a setting mechanism may shift one or more components on the frac plug such that one or more slip components, buttons, etc. may translate along the mandrel and engage with the casing to prevent the frac plug from moving. With multiple components that operate mechanically to set a frac plug in place, the associated cost and risk may increase. For instance, one or more of the components may fail during the setting process, resulting in additional operations and/or cost to retrieve the damaged frac plug.

In some implementations, a frac plug may include a singular tubular structure that may be configured to expand to a desired diameter to set in the casing. The singular tubular structure may be configured with a uniform material that may be configured to expand to contact the inner wall of a tubular (such as casing). Prior to expansion, the outer diameter of the singular tubular structure may be small enough to drift through tubulars or other wellbore components (casing, tubing, liner hangers, etc.) in the wellbore when positioning the frac plug at the desired depth in the wellbore. When the frac plug is positioned at the desired depth, the singular tubular structure may expand to the desired diameter (such as the inner wall of the casing) to hold the frac plug in place. The materials of the singular tubular structure may include any suitable ductile material that may be capable of dissolving in a downhole environment (such as when exposed to formation fluid at reservoir temperatures for a period of time), where the elastic properties of the materials may allow the singular tubular to expand to contact the inner diameter of the casing (inner wall of the casing). The singular tubular structure may expand via a setting tool comprising one or more swedges, or any other components configured to increase the inner diameter and/or the outer diameter of the singular tubular. The one or more swedges may traverse through the inner bore of the singular tubular structure to press the singular tubular structure, expanding the singular tubular structure to contact the inner wall of the casing. In some implementations, the friction between the outer face of the singular tubular structure and the inner wall of the casing may hold the frac plug in place while the outer face of the singular tubular structure is expanded and in contact with the inner wall of the casing. In some implementations, one or more components may be integrated into the singular tubular structure (such as rings machined into the singular tubular structure) and configured to engage with the inner wall of the casing to hold the single tubular structure in place. In some implementations, the frac plug may combine all of the traditional frac plug components into one structure. For instance, the singular tubular structure may include buttons, sealing elements, etc. positioned on the outer wall of the singular tubular structure and configured to engage with the inner wall of the casing while the singular tubular structure is expanded. Once expanded, the setting tool may be completely removed from the frac plug, leaving the frac plug in place at the desired depth in the wellbore. While the frac plug is anchored in place, one or more isolating components such as a sealing device may be positioned in the inner bore of the frac plug to provide differential pressure integrity in the wellbore above and below the frac plug.

Example System

FIG. 1 is an illustration depicting an example well system, according to some implementations. In particular, FIG. 1 is a schematic of a well system 100 that includes a wellbore 102 in a subsurface formation 101. The wellbore 102 includes casing 106 and a number of perforations 190A-190H being made in the casing 106 at different depths to allow reservoir fluids (i.e., oil, water, and gas) from the subsurface formation 101 to flow into the wellbore 102. During hydraulic fracturing operations of the wellbores 102, fracturing fluid, with or without sand, may be pumped into the subsurface formation 101, via the perforations 190A-190H, to generate fractures 150A-150H in the subsurface formation such that reservoir fluid may flow into the wellbore 102.

In some implementations, the wellbore 102 may be hydraulically fractured in stages. For example, a first stage may include hydraulically fracturing the perforations 190G, 190H to generate fractures 150G, 150H, respectively. After the hydraulic fracturing operations for the first stage are complete, a frac plug 130 may be positioned in the casing 106 above the first stage (i.e., at a lesser depth in the wellbore than perforations 190G, 190H). The frac plug 130 may be positioned in the wellbore 102 via any suitable setting method such as wireline. In some implementations, the frac plug 130 may be set by expanding such that the outer face of the frac plug 130 may come into contact with the inner wall of the casing 106, thus holding the frac plug 130 in place. A setting tool on the wireline may press the inner diameter of the frac plug 130 to expand and set the frac plug 130. Once set, an isolating component. may be positioned (e.g., dropped/released from a setting kit in the wellhead 114 or other location on surface 111) in the frac plug 130 to prevent hydraulic communication between the portion of the wellbore 102 below the frac plug 130 (i.e., the first stage that was hydraulically fractured) and the portion of the wellbore 102 above the frac plug 130. Once the sealing component is positioned in the frac plug 130, the perforations 190E, 190F may be formed in the casing 106 and hydraulic fracturing operations may commence for the next stage. Similar operations may be repeated for each subsequent stage (i.e., setting frac plug 132 and frac plug 134 and hydraulically fracturing the next subsequent stage) until hydraulic fracturing operations for the wellbore 102 are complete.

Example Expandable Frac Plugs

Examples configurations of an expandable frac plug are now described. The expandable frac plugs are described in reference to the frac plugs 130-134 of FIG. 1.

Figure 2:
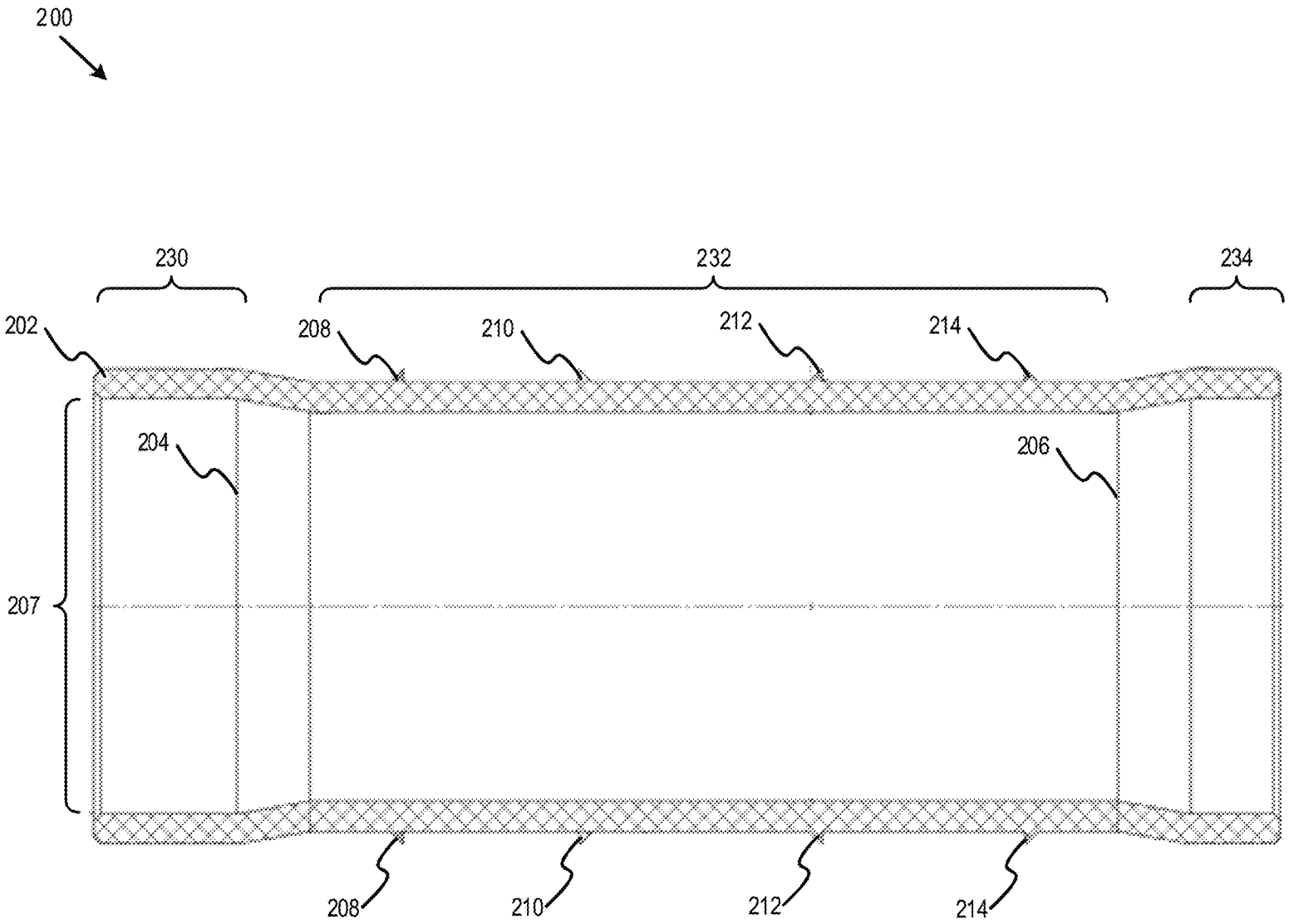
FIG. 2 is a schematic depicting an example expandable frac plug, according to some implementations.

FIG. 2 is a schematic depicting an example expandable frac plug, according to some implementations. In particular, FIG. 2 includes a cross sectional view of a frac plug 200. The frac plug 200 includes a singular tubular structure 202. When the frac plug 200 is positioned, via a setting tool, in the casing of a wellbore, the outer diameter(s) of the frac plug 200 may initially be less than the inner diameter of the casing such that the frac plug 200 may be able to drift through the casing (or any other components in the wellbore such as tubing, liner hanger, etc.) to run in hole to the desired position. For example, the outer diameter of sections 230, 232, and 234 of the frac plug 200 may be less than the inner diameter of the casing. The outer diameter of the of sections, 230, 232, and 234 may be similar and/or different than one another.

Once the frac plug has reached the desired depth in the wellbore, one or more swedges (on the setting tool) may traverse through the inner bore 207 of the frac plug 200 to expand the singular tubular structure 202. The outer diameter of the one or more swedges may be greater than the inner diameter of the frac plug 200, resulting in the one or more swedges pressing against the inner wall(s) of the frac plug 200 to expand the singular tubular structure 202 (i.e., increasing the inner diameter and/or the outer diameter of the singular tubular structure 202). Any suitable tool, method, etc. may be utilized to expand the singular tubular structure 202.

The singular tubular structure 202 may include any suitable ductile material (such as ductile ceramics), where the elasticity of the material may allow for the singular tubular structure to expand to the inner wall of the casing (i.e., inner and outer diameter of the of the frac plug 200 may increase). In some implementations, the singular tubular structure 202 may be made of a single uniform material or a combination of materials. Any suitable configuration of materials may be utilized such that the singular tubular structure 202 may be able to expand and anchor to the inner wall of the casing. In some implementations, the material of the singular tubular structure 202 may be dissolvable. For example, the material may dissolve when exposed to wellbore conditions (e.g., fluids, temperature, etc.) for a period of time. In some implementations, the frac plug 200 may be configured such that one or more sections, such as 230, 232, and 234, may expand via the one or more swedges. For example, all of the sections 230, 232, 234 (i.e., the entire singular tubular structure 202) may expand, two of the sections 230, 232, 234 may expand, or only one section (such as section 232) may expand. Sections 230, 232, 234, may expand in any suitable sequence. The expansion of sections may be governed by the inner diameter of the singular tubular structure 202 and/or the outer diameter of the one or more swedges. For example, a swedge and/or one or more sections 230, 232, 234 may be designed such that the one or more swedges may contact and expand the section(s) configured to expand.

In some implementations, the expansion of one or more sections 230, 232, 234 may occur in any suitable sequence. For example, a first swedge may traverse through a first end (such as the distal end corresponding to section 230) and then continue to traverse through the singular tubular structure 202 and out through the second end (such as the distal end corresponding to the section 234) to expand any section of the singular tubular structure 202 where the inner diameter is less than the outer diameter of the swedge. Alternatively, a first swedge may traverse through the first end to expand section 230 and section 232, before being removed from the singular tubular structure 202 (either through the first end or second end). A second swedge may then traverse through the second end to expand the section 234, before being removed from the singular tubular structure 202 (either through the first end or second end). Any suitable method for expanding the one or more sections 230, 232, 234 may be utilized to expand the singular tubular structure 202 and set the frac plug 200 at approximately the desired depth. In some implementation, one or more sections 230, 232, 234 may expand but not contact the inner wall of the casing. For example, when the singular tubular structure 202 is expanded, section 232 may contact the inner wall of the casing and sections 230, 234 may be expanded such that the outer diameter has increased from the original position but does not contact the inner wall of the casing.

Once in position, the one or more swedges (and any other components on the setting tool) may be removed from frac plug 200, leaving only the expanded frac plug in position in the casing.

The singular tubular structure 202 may expand such that the outer face of the singular tubular structure 202 may at least partially be in contact with the inner wall of the casing (or any other suitable tubular the frac plug 200 may be positioned in). In some implementations, a friction force between the outer face of the tubular structure and the inner wall of the casing may hold the frac plug 200 in place. For example, the friction force may be greater than the force applied to the frac plug 200 via flowing fluid, sand, etc. in the casing such that the frac plug remains in place. In some implementations, the roughness of the outer face of the singular tubular structure 202 may be increased (e.g., texture added to the outer face) to increase the friction factor between the outer face of the singular tubular structure 202 and the inner wall of the casing. In some implementations, the elastic properties (such as Young's modulus, Poisson's ratio, shear modulus, etc.) of the singular tubular structure 202 may hold the frac plug 200 in place.

In some implementations, one or more components may engage with the casing to hold the frac plug 200 in place. The one or more components may be integrated (e.g., machined) into the singular tubular structure 202. For instance, FIG. 2 depicts rings 208-214 around the outer face of the singular tubular structure 202 and machined into the singular tubular structure 202. The rings 208-214 may be configured to engage with the casing (e.g., bite into the inner wall of the casing) to prevent the frac plug 200 from moving through the casing during the setting process and/or during hydraulic fracturing operations. A portion of the rings 208-214 may prevent movement in a first direction and the other portion of the ring 208-214 may prevent movement in the opposite direction (such as when one or more swedges are pushed/pulled through the singular tubular structure 202). For example, rings 208 and 212 may be configured in a wedge shape with one face of the edge having a 45 degree angle (or any other suitable angle) relative to the central axis of the frac plug 200 and the other face of the wedge having a 90 degree angle (or any other suitable angle) relative to the central axis of the frac plug 200. The rings 210 and 214 may be configured similar to the rings 208 and 212, but with the faces of the wedge shape facing in opposite directions. In some implementations, the one or more components may include one or more grooves machined into the singular tubular structure 202. In some implementations, the one or more components may be separate components from the singular tubular structure 202. For example, one or more components may include buttons, wedges, heavy grit, etc. (or any combination thereof) positioned on the outer face of the singular tubular structure 202. Any suitable combination of one or more components (integrated and separate) at any suitable position on the singular tubular structure 202 may be utilized to position and/or hold the frac plug 200 in place.

Once the frac plug 200 is in place, one or more isolating components such as a sealing device (e.g., a cone shaped device, egg shaped device, ball, dart, etc.) may be positioned in the inner bore 207 of the frac plug 200 to provide differential pressure integrity above and below the frac plug 200 in the casing. The inner bore 207 of the frac plug 200 may include different inner diameters between the sections 230, 232, 234. In some implementations, the transition 204, 206 between changes in inner diameters may provide a seat where the isolating component may be positioned. In some implementations, the transition 204, 206 may include a profile specific for the isolating component such that the isolating component may provide a hydraulic seal between the inner wall of the singular tubular structure 202 and the outer surface of the isolating component. For example, the transition 204 be configured with a profile shaped for a ball such that a ball may be positioned in the transition 204 to provide differential pressure integrity above and below the ball and thus above and below the frac plug 200.

Figure 3:
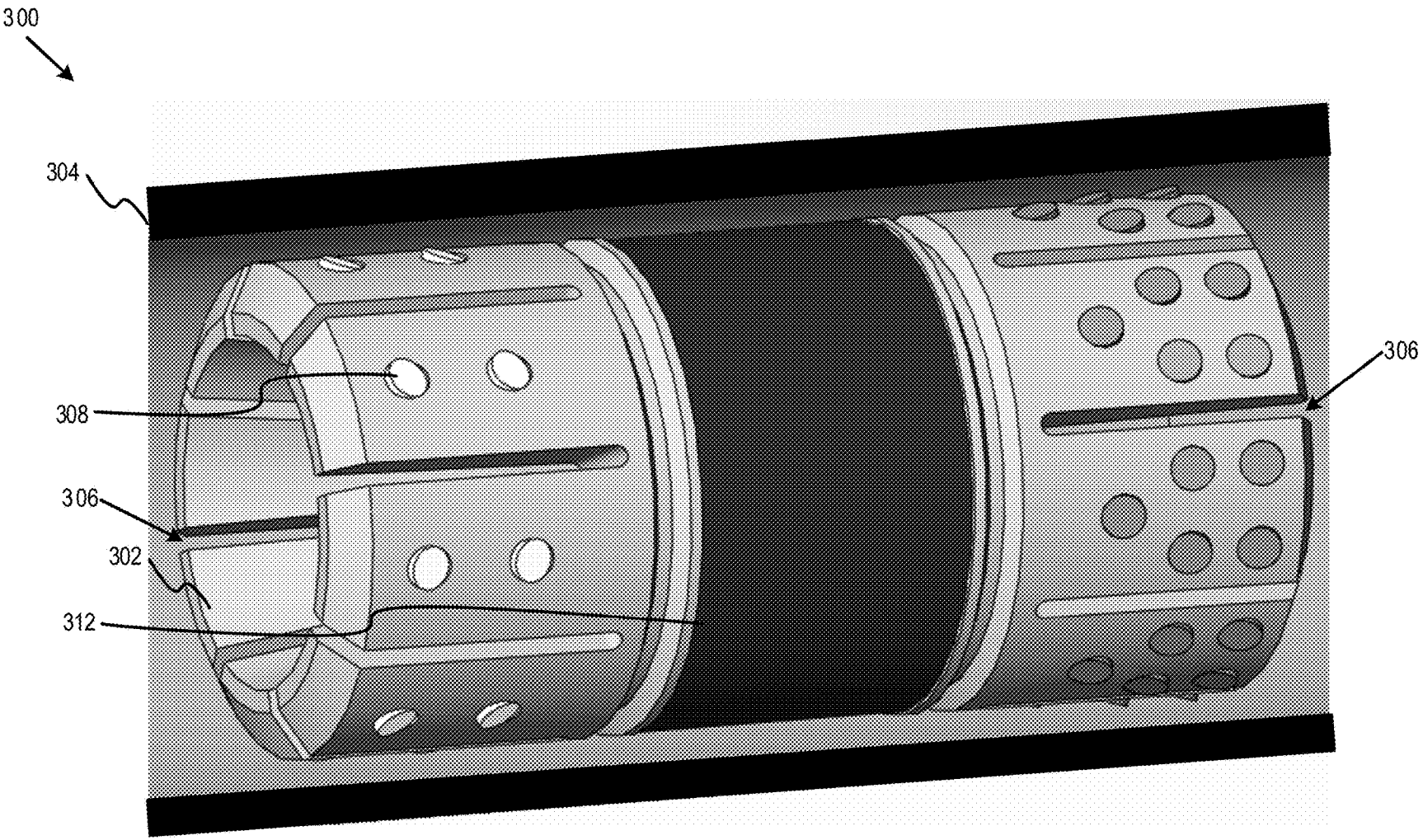
FIG. 3 is a schematic depicting an example expandable frac plug, according to some implementations.

FIG. 3 is a schematic depicting an example expandable frac plug, according to some implementations. In particular, FIG. 3 includes an illustration of a frac plug 300. The frac plug 300 may be similar to the frac plug 200 of FIG. 2. For example, the frac plug 300 includes a singular tubular structure 302 that may expand such that at least a portion of the outer face (or any components coupled to the outer face of the singular tubular structure such as buttons, sealing elements, etc.) of the singular tubular structure 302 may contact the inner wall of the casing 304 (or any other suitable tubular the frac plug 300 may be positioned in). Differential pressure integrity may be provided by the frac plug 300 while one or more isolating components are positioned in the inner bore of the frac plug 300.

In some implementations, sections of the singular tubular structure 302 may be configured with channels 306. The channels 306 may be proximate the distal ends of the frac plug allow corresponding sections of the singular tubular structure 302 to expand into the casing 304 while also maintaining structural integrity. Sections of the singular tubular structure 302 may include one or more components that, while the singular tubular structure 302 is expanded into the casing, engage with the casing 304 to prevent the frac plug 300 from moving the casing 304. The one or more components may include buttons 308, slips, wedges, heavy grit, or any combination thereof. Any suitable number of components may be coupled with the singular tubular structure 302. Additionally, the one or more components may be positioned in any suitable location on the singular tubular structure 302. The components may include materials with a hardness high enough to penetrate the casing 304, such as ceramic. In some implementations, the frac plug 300 may include a sealing element 312 made of any suitable polymer, elastomer, etc. When the singular tubular structure 302 is expanded, the sealing element 312 may come into contact with the inner wall of the casing 304, providing a seal between the singular tubular structure 302 and the casing 304.

Figure 4:
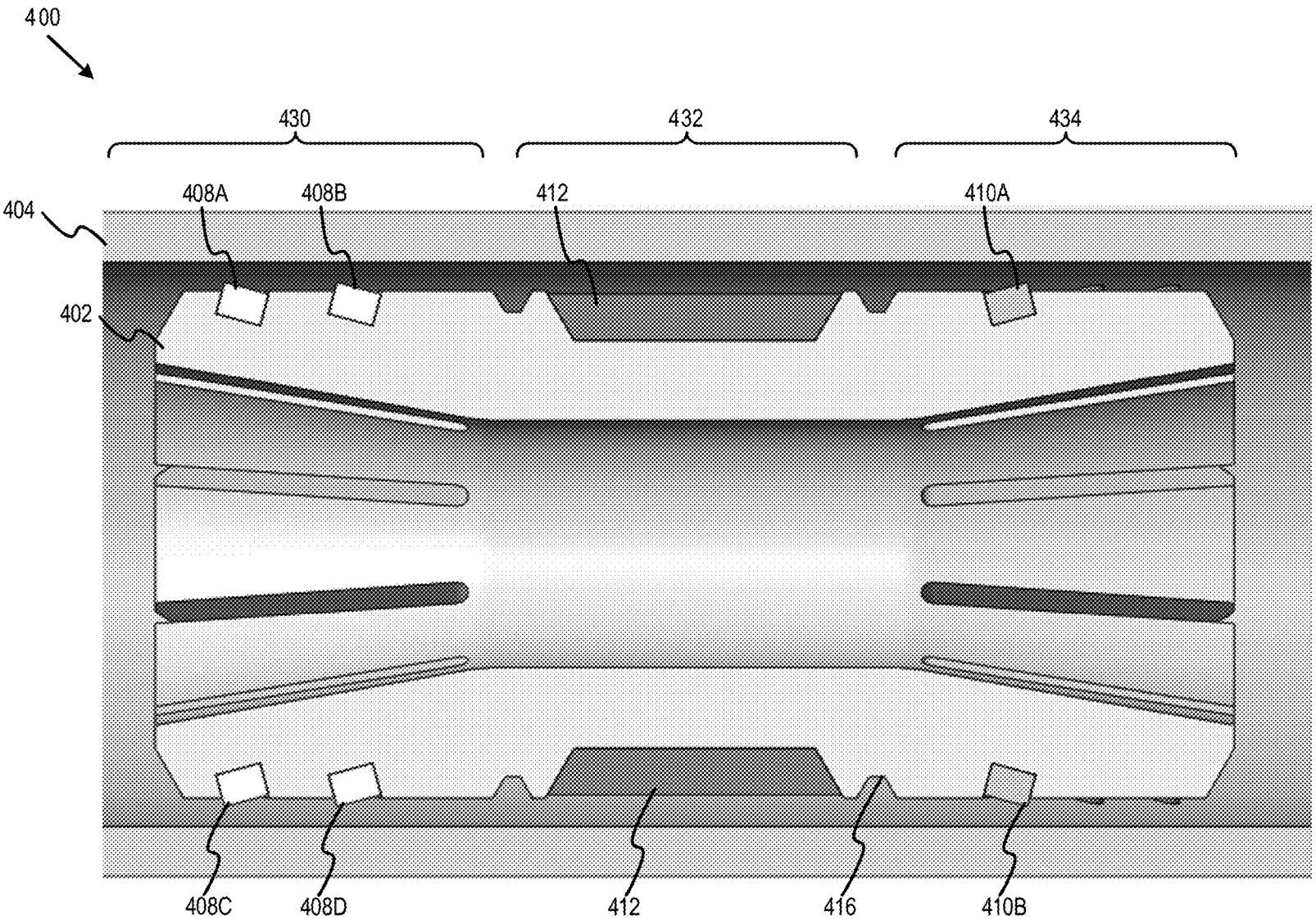
FIG. 4 is a schematic depicting an example expandable frac plug, according to some implementations.

FIG. 4 is a schematic depicting an example expandable frac plug, according to some implementations. In particular, FIG. 4 includes a cross section of a frac plug 400. The frac plug 400 may be similar to the frac plug 300 of FIG. 3. For example, the frac plug 400 includes a singular tubular structure 402 that may be configured to expand such that at least a portion of the outer face (and any components coupled to the outer face of the singular tubular structure 402 such as buttons 408A-D, 410A-B, sealing element 412, etc.) of the singular tubular structure 302 may contact the inner wall of the casing 404 (or any other suitable tubular the frac plug 400 may be positioned in). The frac plug 400 depicted in FIG. 4 includes a singular tubular structure 402 that has not been expanded into the inner wall of the casing 404. The outer diameter of the frac plug 400 is less than the inner diameter of the casing 404 (i.e., Sections 430-434 have not been expanded into the inner wall of the casing 404 so buttons 408A-D, 410A-B, sealing element 412, do not engage with the inner wall of the casing 404), allowing the frac plug to traverse through the casing 404.

Figure 5:
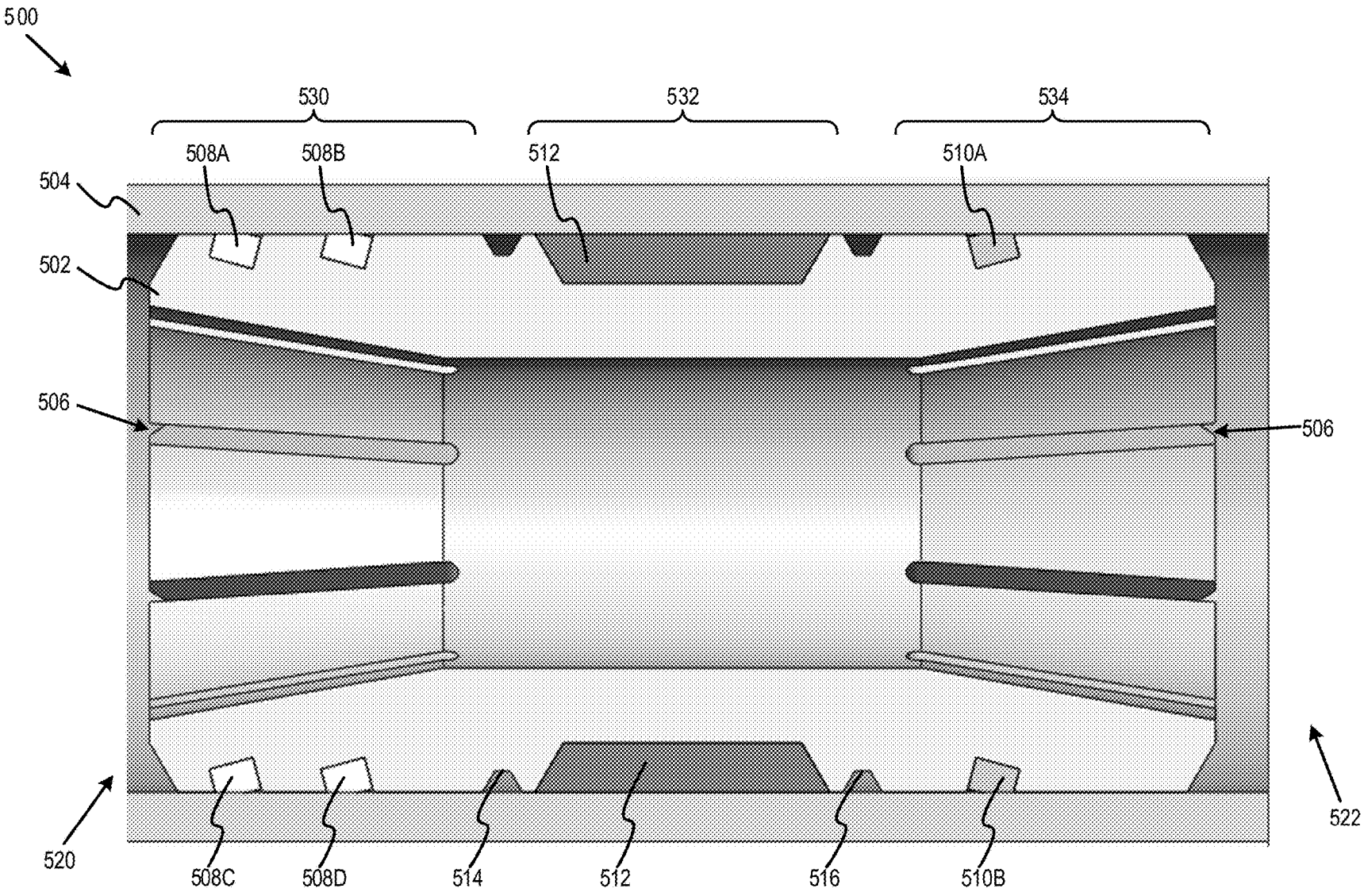
FIG. 5 is a schematic depicting an example expandable frac plug, according to some implementations.

FIG. 5 is a schematic depicting an example expandable frac plug, according to some implementations. In particular, FIG. 5 includes a cross section of a frac plug 500 that has been expanded to contact the inner wall of the casing 504. The frac plug 500 may be similar to the frac plug 400 of FIG.

4. For example, the frac plug 500 includes a singular tubular structure 502 that may be configured to expand such that at least a portion of the outer face (and any components coupled to the outer face of the singular tubular structure 502 such as buttons 508A-D, 510A-B, sealing element 512, etc.) of the singular tubular structure 502 may contact the inner wall of the casing 504 (or any other suitable tubular the frac plug 500 may be positioned in). While expanded, at least one of the buttons 508A-D, 510A-B, sealing element 512, and any combination thereof may engage with the inner wall of the casing 504, holding the frac plug 500 in position and a seal between the frac plug 500 and the casing 504 may be formed. The seal may include a seal between the outer body of the singular tubular structure 502 and the casing 504, between one or more sealing elements 512 positioned on the outer face of the singular tubular structure 502 and the inner wall of the casing 504, and any combination thereof.

The frac plug 500 may be positioned in the casing of a wellbore via a setting tool. In some implementations, the setting tool may include one or more swedges that may be configured to press through the inner bore of the frac plug 500 to expand the singular tubular structure 502 into the inner wall of the casing 504 (i.e., the outer diameter of the frac plug 500 becomes approximately similar to the inner diameter of the casing 504) once positioned at the desired depth in the wellbore. For example, a first swedge with a diameter greater than the inner diameter of the inner bore of section 530 may be pressed into to top section 520 of the frac plug 500 to expand the section 530 such that the outer face of the section 530 expands to contact the inner wall of the casing 504. In some implementations, the singular tubular structure 502 may include relief channels such as channels 506 that may allow the section 530 of the singular tubular structure 502 to expand to the inner diameter of the casing 504 to minimize compressing the material within the section 530 and rather allow the material between the relief channels 506 to flex toward the casing 504. Once expanded, the buttons 508A-D may engage with the inner wall of the casing 504, preventing the frac plug 500 from traversing in the direction towards the top section 520. The first swedge may be pressed into the singular tubular structure until a desired stopping point (e.g., section 530 has been expanded, the first swedge has pressed through a desired length in the singular tubular structure 502, etc.). Thereafter, a second swedge may be pulled into the singular tubular structure 502 from the other end of the frac plug 500 (bottom section 522).

The second swedge may be pressed through the remaining portions of the inner bore to expand the other sections 532, 534 such that the outer face of the sections 532, 534 expands into the inner wall of the casing 504. Due to the buttons 508A-D engaging with the inner wall of the casing 504, the sections 532, 534 may expand via the second swedge without the frac plug 500 moving positions in the casing 504 (i.e., traversing towards the top section 520). Section 534 may include relief channels 506 such that the material of section 534 may also expand similar to section 530. While expanded, the buttons 510A-B of the section 534 may be engaged with the inner wall of the casing 504 to prevent the frac plug 500 from traversing in the direction of the bottom section 522. Additionally, the sealing element 512 of the section 532 may expand to contact the inner wall of the casing 504 when section 532 is expanded, creating a hydraulic seal. Channels 514 may limit the extrusion of the sealing element 512 while pressed against the inner wall of the casing 504. Once the singular tubular structure 502 has been fully expanded, the setting tool (one or more swedges) may be removed from the inner bore of the frac plug 500, resulting in the expanded frac plug 500 positioned in the casing 504 with an open inner bore.

Figure 6:
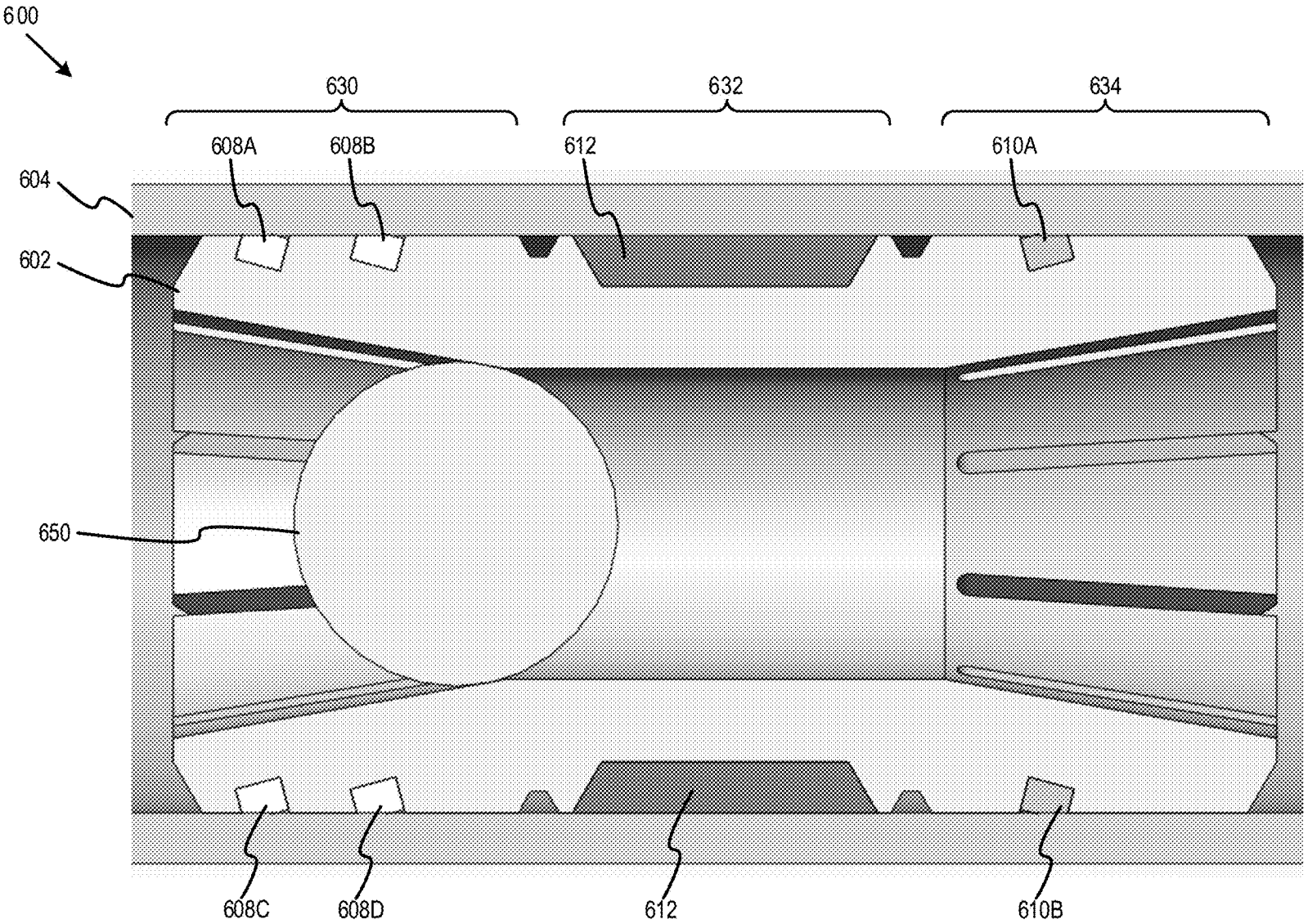
FIG. 6 is a schematic depicting an example expandable frac plug, according to some implementations.

FIG. 6 is a schematic depicting an example expandable frac plug, according to some implementations. In particular, FIG. 6 includes a cross section of a frac plug 600 that has been expanded to contact the inner wall of the casing 504 and an isolating component 650 is positioned in the inner bore of the frac plug 600 to provide positive differential integrity across the frac plug 600. The frac plug 600 may be similar to the frac plug 500 of FIG. 5. For example, the frac plug 600 includes a singular tubular structure 602 that may be configured to expand such that at least a portion of the outer face (and any components coupled to the outer face of the singular tubular structure 602 such as buttons 608A-D, 610A-B, sealing element 612, etc.) of the singular tubular structure 602 may contact the inner wall of the casing 604 (or any other suitable tubular the frac plug 600 may be positioned in). While expanded, at least one of the buttons 608A-D, 610A-B, sealing element 612, and any combination thereof may engage with the inner wall of the casing 604, holding the frac plug 600 in position and a seal between the frac plug 600 and the casing 604 is formed.

Once the frac plug 600 is expanded and the seal is formed, an isolating component 650 may be positioned in the inner bore of the frac plug 600. In some implementations, the isolating component 650 may be dropped/released from a setting kit (on or proximate the wellhead on the surface). The inner bore of the frac plug 600 may include different inner diameters. For example, the inner diameter corresponding to section 630 may be greater than the inner diameter corresponding to section 632 (following the expansion of the singular tubular structure 602). The isolating component 650 may be configured to be positioned in the portion of the inner bore where inner diameter transitions from the section 630 to the section 632. For instance, the outer diameter of a ball may be less than the inner diameter corresponding to the section 630, and greater than the inner diameter corresponding to the section 632, resulting in the ball being positioned in the inner bore between the section 630 and the section 632. In some implementations, the inner bore may include a profile configured for the isolating component 650 where the isolating component 650 may be positioned. Once the isolating component 650 is positioned in the frac plug 600, a seal may be formed such that there may be approximately no hydraulic communication through the inner bore of the frac plug 600, providing a positive differential pressure across the frac plug 600.

Example Operations

Examples operations are now described.

Figure 7:
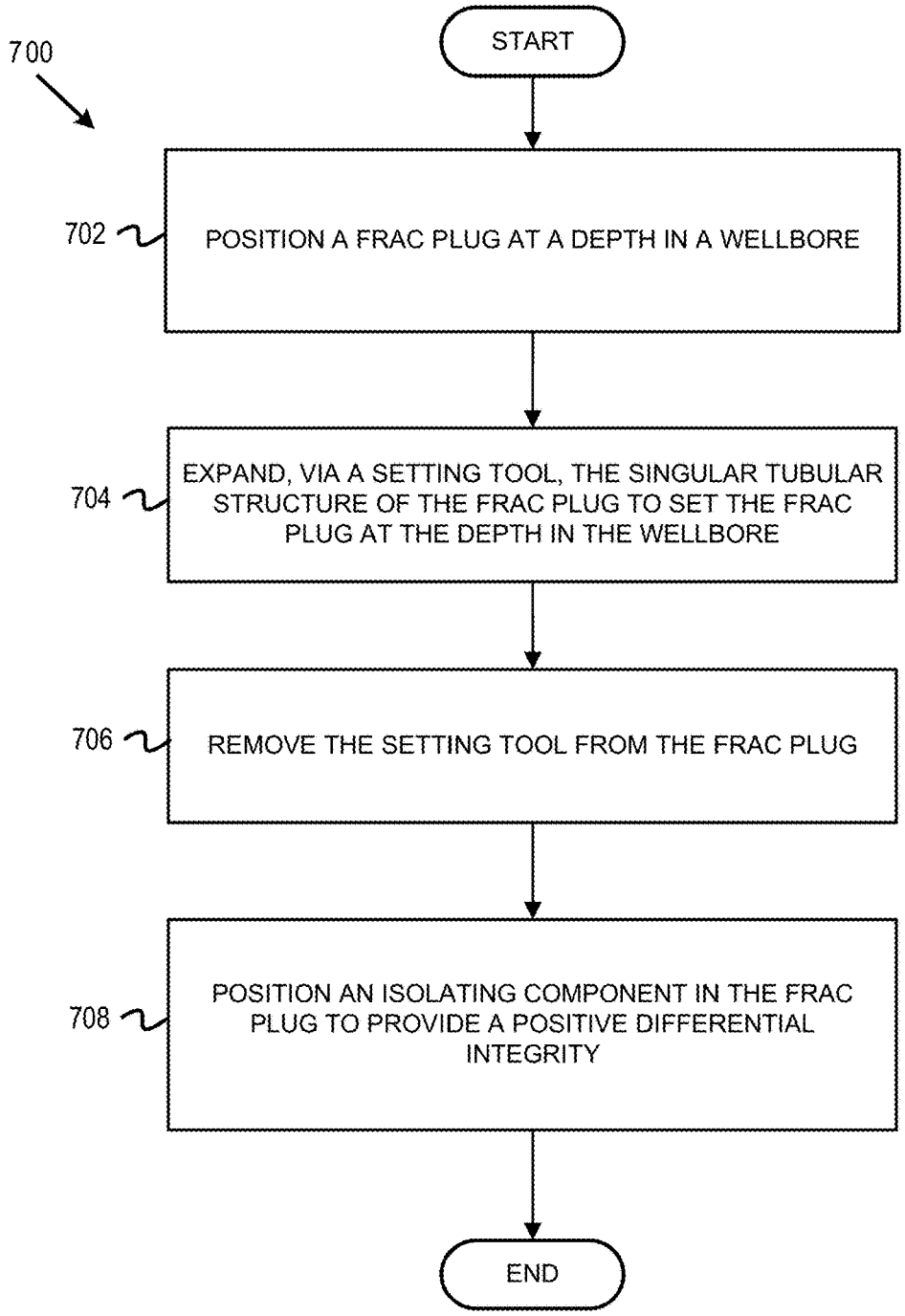
FIG. 7 is a flowchart depicting example operations for positioning an expandable frac plug in a wellbore, according to some implementations.

FIG. 7 is a flowchart depicting example operations for positioning an expandable frac plug in a wellbore, according to some implementations. FIG. 7 depicts a flowchart 700 of operations to position an expandable frac plug comprising a singular tubular structure at a desired depth in casing of a wellbore. The operations of flowchart 700 are described in reference to the expandable frac plugs 200-600 described in FIGS. 2-6, respectively.

At block 702, an expandable frac plug may be positioned at a depth in a wellbore. The expandable frac plug may be run in and positioned in the casing of a wellbore via a setting tool. While running in the wellbore, the outer diameter of the frac plug may be less than the inner diameter of the casing.

At block 704, the singular tubular structure of the frac plug may be expanded, via the setting tool, to set the frac plug at the desired depth in the wellbore. The setting tool may include one or more swedges that may be pressed through the singular tubular structure, expanding the singular tubular structure to contact the inner wall of the casing. In some implementations, the singular tubular structure may include one or more components that may engage with the casing to assist in holding the frac plug in place.

At block 706, the setting tool may be removed from the frac plug. Once removed, the frac plug may remain at the desired depth with an open inner bore.

At block 708, an isolating component may be positioned in the frac plug to provide a positive differential integrity. In some implementations, hydraulic fracturing operations may begin once the isolating components is positive differential integrity is achieved.

While the aspects of the disclosure are described with reference to various implementations and exploitations, it will be understood that these aspects are illustrative and that the scope of the claims is not limited to them. In general, techniques for expanding an expandable frac plug herein may be implemented with facilities consistent with any hardware system or hardware systems. Many variations, modifications, additions, and improvements are possible.

Plural instances may be provided for components, operations or structures described herein as a single instance. Finally, boundaries between various components, operations and data stores are somewhat arbitrary, and particular operations are illustrated in the context of specific illustrative configurations. Other allocations of functionality are envisioned and may fall within the scope of the disclosure. In general, structures and functionality presented as separate components in the example configurations may be implemented as a combined structure or component. Similarly, structures and functionality presented as a single component may be implemented as separate components. These and other variations, modifications, additions, and improvements may fall within the scope of the disclosure.

Various modifications to the implementations described in this disclosure may be readily apparent to those skilled in the art, and the generic principles defined herein may be applied to other implementations without departing from the spirit or scope of this disclosure. Thus, the claims are not intended to be limited to the implementations shown herein but are to be accorded the widest scope consistent with this disclosure, the principles and the novel features disclosed herein.

Certain features that are described in this specification in the context of separate implementations also may be implemented in combination in a single implementation. Conversely, various features that are described in the context of a single implementation also may be implemented in multiple implementations separately or in any suitable subcombination. Moreover, although features may be described as acting in certain combinations and even initially claimed as such, one or more features from a claimed combination may in some cases be excised from the combination, and the claimed combination may be directed to a subcombination or variation of a subcombination.

Similarly, while operations are depicted in the drawings in a particular order, this should not be understood as requiring that such operations be performed in the particular order shown or in sequential order, or that all illustrated operations be performed, to achieve desirable results. Further, the drawings may schematically depict one more example process in the form of a flow diagram. However, some operations may be omitted and/or other operations that are not depicted may be incorporated in the example processes that are schematically illustrated. For example, one or more additional operations may be performed before, after, simultaneously, or between any of the illustrated operations. In certain circumstances, multitasking and parallel processing may be advantageous. Moreover, the separation of various system components in the implementations described should not be understood as requiring such separation in all implementations, and the described program components and systems may generally be integrated together in a single software product or packaged into multiple software products. Additionally, other implementations are within the scope of the following claims. In some cases, the actions recited in the claims may be performed in a different order and still achieve desirable results.

Unless otherwise specified, use of the terms "up," "upper," "upward," "uphole," "upstream," or other like terms shall be construed as generally away from the bottom, terminal end of a well; likewise, use of the terms "down," "lower," "downward," "downhole," or other like terms shall be construed as generally toward the bottom, terminal end of the well, regardless of the wellbore orientation. Use of any one or more of the foregoing terms shall not be construed as denoting positions along a perfectly vertical axis. In some instances, a part near the end of the well can be horizontal or even slightly directed upwards. Unless otherwise specified, use of the term "subsurface formation" shall be construed as encompassing both areas below exposed earth and areas below earth covered by water such as ocean or fresh water.

Example Implementations

Implementation #1: An apparatus comprising: a singular tubular structure to be positioned inside casing of a wellbore formed in a subsurface formation, wherein the singular tubular structure is configured to expand to contact an inner wall of the casing and provide differential pressure integrity in the wellbore while an isolating component is positioned in the singular tubular structure.

Implementation #2: The apparatus of Implementation #1 further comprising: a first inner diameter of the singular tubular structure that is less than a second inner diameter of the singular tubular structure, wherein the isolating component is positioned in a transition between the first inner diameter and the second inner diameter after the singular tubular structure is expanded to provide the differential pressure integrity in the wellbore.

Implementation #3: The apparatus of Implementation #2, wherein the transition includes a profile for the isolating component.

Implementation #4: The apparatus of any one or more of Implementation #1-3, wherein the isolating component includes a dart or a ball.

Implementation #5: The apparatus of any one or more of Implementation #1-4, wherein the singular tubular structure includes a dissolvable material.

Implementation #6: The apparatus of Implementation #5, wherein one or more components are integrated into the dissolvable material of the singular tubular structure and configured to engage with the inner wall of the casing and hold the singular tubular structure at a position in the casing when the singular tubular structure is expanded.

Implementation #7: The apparatus of any one or more of Implementation #1-6, wherein the singular tubular structure is held in a position in the casing due to a friction force between the inner wall of the casing and an outer face of the singular tubular structure when the singular tubular structure is expanded.

Implementation #8: The apparatus of any one or more of Implementation #1-7, wherein the singular tubular structure is held in a position in the casing based on elastic properties of material of the singular tubular structure.

Implementation #9: The apparatus of any one or more of Implementation #1-8, wherein one or more swedges are traversed through the singular tubular structure to expand the singular tubular structure to contact the inner wall of the casing, and wherein the one or more swedges are removed from the singular tubular structure after the singular tubular structure is expanded.

Implementation #10: A system comprising: a singular tubular structure to be positioned inside casing of a wellbore formed in a subsurface formation, wherein the singular tubular structure is configured to expand into an inner wall of the casing; and an isolating component to be positioned in the singular tubular structure to provide differential pressure integrity in the wellbore.

Implementation #11: The system of Implementation #10 further comprising: a first inner diameter of the singular tubular structure that is less than a second inner diameter of the singular tubular structure, wherein the isolating component is positioned in a transition between the first inner diameter and the second inner diameter after the singular tubular structure is expanded to provide the differential pressure integrity in the wellbore.

Implementation #12: The system of Implementation #11, wherein the transition includes a profile for the isolating component.

Implementation #13: The system of any one or more of Implementation #10-12, wherein the isolating component includes a dart or a ball.

Implementation #14: The system of any one or more of Implementation #10-13, wherein the singular tubular structure includes a dissolvable material.

Implementation #15: The system of Implementation #14, wherein one or more components are integrated into the dissolvable material of the singular tubular structure and configured to engage with the inner wall of the casing and hold the singular tubular structure at a position in the casing when the singular tubular structure is expanded.

Implementation #16: The system of any one or more of Implementation #10-15, wherein the singular tubular structure is held in a position in the casing due to a friction force between the inner wall of the casing and an outer wall of the singular tubular structure when the singular tubular structure is expanded.

Implementation #17: The system of any one or more of Implementation #10-16, wherein a maximum outer diameter of the singular tubular structure is less than an inner diameter of the casing prior to expansion of the singular tubular structure.

Implementation #18: The system of any one or more of Implementation #10-17, wherein one or more swedges are traversed through the singular tubular structure to expand the singular tubular structure to contact the inner wall of the casing, and wherein the one or more swedges are removed from the singular tubular structure after the singular tubular structure is expanded.

Implementation #19: A method comprising: positioning a singular tubular structure at a depth inside a casing of a wellbore formed in a subsurface formation; expanding, via a setting tool, the singular tubular structure to contact an inner wall of the casing; removing the setting tool from singular tubular structure; and positioning an isolating component in the singular tubular structure to provide differential pressure integrity in the wellbore.

Implementation #20: The method of Implementation #19, wherein the setting tool includes one or more swedges, and wherein the one or more swedges are traversed through the singular tubular structure to expand the singular tubular structure to contact the inner wall of the casing.

Use of the phrase "at least one of" preceding a list with the conjunction "and" should not be treated as an exclusive list and should not be construed as a list of categories with one item from each category, unless specifically stated otherwise. A clause that recites "at least one of A, B, and C" can be infringed with only one of the listed items, multiple of the listed items, and one or more of the items in the list and another item not listed.

As used herein, the term "or" is inclusive unless otherwise explicitly noted. Thus, the phrase "at least one of A, B, or C" is satisfied by any element from the set {A, B, C} or any combination thereof, including multiples of any element.

The invention claimed is:

1. An apparatus comprising:

a singular tubular structure that is a continuous cylinder and configured to be positioned inside casing of a wellbore formed in a subsurface formation, wherein the singular tubular structure is configured to expand to contact an inner wall of the casing and provide differential pressure integrity in the wellbore while an isolating component is positioned in the singular tubular structure, and wherein the singular tubular structure includes one or more components formed into an outer face of the singular tubular structure and configured to engage with the inner wall of the casing with the expansion of the singular tubular structure.

2. The apparatus of claim 1 further comprising:

a first inner diameter of the singular tubular structure that is less than a second inner diameter of the singular tubular structure, wherein the isolating component is positioned in a transition between the first inner diameter and the second inner diameter after the singular tubular structure is expanded to provide the differential pressure integrity in the wellbore.

3. The apparatus of claim 2, wherein the transition includes a profile for the isolating component.

4. The apparatus of claim 1, wherein the isolating component includes a dart or a ball.

5. The apparatus of claim 1, wherein the singular tubular structure includes a dissolvable material.

6. The apparatus of claim 5, wherein one or more components are integrated into the dissolvable material of the singular tubular structure and configured to engage with the inner wall of the casing and hold the singular tubular structure at a position in the casing when the singular tubular structure is expanded.

7. The apparatus of claim 1, wherein the singular tubular structure is held in a position in the casing due to a friction force between the inner wall of the casing and an outer face of the singular tubular structure when the singular tubular structure is expanded.

8. The apparatus of claim 1, wherein the singular tubular structure is held in a position in the casing based on elastic properties of material of the singular tubular structure.

9. The apparatus of claim 1, wherein the singular tubular structure is configured so no setting tools are to remain in the singular tubular structure after the singular tubular structure is expanded.

10. A system comprising:

a singular tubular structure that is a continuous cylinder and configured to be positioned inside casing of a wellbore formed in a subsurface formation, wherein the singular tubular structure is configured to expand into an inner wall of the casing, and wherein the singular tubular structure includes one or more components formed into an outer face of the singular tubular structure and configured to engage with the inner wall of the casing with the expansion of the singular tubular structure; and an isolating component to be positioned in the singular tubular structure to provide differential pressure integrity in the wellbore.

11. The system of claim 10 further comprising:

a first inner diameter of the singular tubular structure that is less than a second inner diameter of the singular tubular structure, wherein the isolating component is positioned in a transition between the first inner diameter and the second inner diameter after the singular tubular structure is expanded to provide the differential pressure integrity in the wellbore.

12. The system of claim 11, wherein the transition includes a profile for the isolating component.

13. The system of claim 10, wherein the isolating component includes a dart or a ball.

14. The system of claim 10, wherein the singular tubular structure includes a dissolvable material.

15. The system of claim 14, wherein one or more components are integrated into the dissolvable material of the singular tubular structure and configured to engage with the inner wall of the casing and hold the singular tubular structure at a position in the casing when the singular tubular structure is expanded.

16. The system of claim 10, wherein the singular tubular structure is held in a position in the casing due to a friction force between the inner wall of the casing and an outer wall of the singular tubular structure when the singular tubular structure is expanded.

17. The system of claim 10, wherein a maximum outer diameter of the singular tubular structure is less than an inner diameter of the casing prior to expansion of the singular tubular structure.

18. The system of claim 10, wherein the singular tubular structure is configured so no setting tools are to remain in the singular tubular structure after the singular tubular structure is expanded.

19. A method comprising:

positioning a singular tubular structure that is a continuous cylinder at a depth inside a casing of a wellbore formed in a subsurface formation;

expanding, via a setting tool, the singular tubular structure to contact an inner wall of the casing, wherein the singular tubular structure includes one or more components formed into an outer face of the singular tubular structure and configured to engage with the inner wall of the casing with the expansion of the singular tubular structure;

removing the setting tool from singular tubular structure; and positioning an isolating component in the singular tubular structure to provide differential pressure integrity in the wellbore.

20. The method of claim 19, wherein the singular tubular structure is configured so no setting tools are to remain in the singular tubular structure to expand the singular tubular structure to contact the inner wall of the casing.

* * * * *